US010761470B2

(12) United States Patent
Endo et al.

(10) Patent No.: US 10,761,470 B2
(45) Date of Patent: Sep. 1, 2020

(54) PRINTING APPARATUS AND LIGHT-EMITTING ELEMENT DRIVING DEVICE

(71) Applicant: CANON KABUSHIKI KAISHA, Tokyo (JP)

(72) Inventors: Wataru Endo, Tokyo (JP); Masanobu Ohmura, Yokohama (JP); Hirotaka Shiomichi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/560,884

(22) Filed: Sep. 4, 2019

(65) Prior Publication Data

US 2020/0089155 A1 Mar. 19, 2020

(30) Foreign Application Priority Data

Sep. 14, 2018 (JP) ..... 2018-172823

(51) Int. Cl.
*G03G 15/04* (2006.01)
*G03G 15/00* (2006.01)

(52) U.S. Cl.
CPC ... *G03G 15/80* (2013.01); *G03G 2215/00628* (2013.01); *G03G 2215/00632* (2013.01); *G03G 2215/025* (2013.01); *G03G 2215/0407* (2013.01)

(58) Field of Classification Search
CPC ..... G03G 15/80; G03G 2215/0407; G03G 2215/00632; G03G 2215/025; G03G 2215/00628
See application file for complete search history.

(56) References Cited

U.S. PATENT DOCUMENTS 5,015,836 A * 5/1991 Van Antwerp ..... G01D 3/036 250/205
5,036,519 A * 7/1991 Ema ..... G11B 7/126 369/116
5,914,484 A * 6/1999 Tawarayama ..... G01R 13/402 250/205
6,392,215 B1 * 5/2002 Baumgartner ..... H01S 5/042 250/205
8,830,286 B2 * 9/2014 Toyoizumi ..... B41J 2/471 347/118
9,459,552 B2 10/2016 Endo ..... G03G 15/5004
(Continued)

FOREIGN PATENT DOCUMENTS

JP 2017-063110 3/2017

*Primary Examiner* — G. M. A Hyder
(74) *Attorney, Agent, or Firm* — Venable LLP

(57) ABSTRACT

A printing apparatus is provided. The apparatus comprises a light-emitting element, a light-receiving element including a first terminal and a second terminal, a reference current generator supplying a reference current, a comparator comparing a monitor current with the reference current, the light-receiving element supplying the monitor current to the second terminal in accordance with a light emission amount, a driver driving the light-emitting element based on an output of the comparator, and a reference voltage controller. The comparator includes a first input terminal connected to the second terminal and a second input terminal. The reference voltage controller supplies a reference voltage selected from at least two voltage values to the second input terminal, and to control the voltage of the second terminal to be a voltage according to the reference voltage.

20 Claims, 4 Drawing Sheets

(56) References Cited

U.S. PATENT DOCUMENTS

| | | | | |
|---|---|---|---|---|
| 10,025,219 | B2 | 7/2018 | Endo et al. | G03G 15/043 |
| 2001/0026566 | A1* | 10/2001 | Taguchi | H01S 5/0683 372/38.02 |
| 2002/0186362 | A1* | 12/2002 | Shirai | G01S 17/36 356/5.05 |
| 2003/0169226 | A1* | 9/2003 | Yamada | H05B 45/37 345/102 |
| 2003/0213890 | A1* | 11/2003 | Mochiduki | H01S 5/0683 250/205 |
| 2005/0025259 | A1* | 2/2005 | Miyasita | H03K 5/003 375/319 |
| 2013/0328992 | A1* | 12/2013 | Hayakawa | G03G 15/80 347/224 |
| 2014/0071219 | A1* | 3/2014 | Kurashima | H01S 5/0683 347/224 |
| 2017/0052473 | A1* | 2/2017 | Seki | G03G 15/80 |
| 2017/0090336 | A1* | 3/2017 | Endo | H05B 47/105 |

* cited by examiner

PRINTING APPARATUS AND LIGHT-EMITTING ELEMENT DRIVING DEVICE

BACKGROUND OF THE INVENTION

Field of the Invention

The present invention relates to a printing apparatus and a light-emitting element driving device.

Description of the Related Art

An electrophotographic printing apparatus (a laser printer or the like) includes a light-emitting element configured to irradiate a photosensitive drum with a laser beam. Among printing apparatuses, there is a printing apparatus having an auto power control (APC) function of controlling driving of a light-emitting element such that a laser beam is maintained at an appropriate light amount (target value). Japanese Patent Laid-Open No. 2017-63110 discloses a printing apparatus having an APC function, which includes a light-emitting element, a light-receiving element configured to output a monitor current corresponding to a light emission amount of the light-emitting element, a determination unit configured to compare the monitor current with a reference current, and a driving unit configured to drive the light-emitting element based on a comparison result by the determination unit.

SUMMARY OF THE INVENTION

In the arrangement of Japanese Patent Laid-Open No. 2017-63110, the monitor current and the reference current are input to the inverting input terminal of a comparator used in the determination unit, and a reference voltage is input to the noninverting input terminal. When performing APC, the comparator operates such that the voltage of the inverting input terminal equals the reference voltage. Hence, a reverse bias voltage applied to the light-receiving element at the time of the APC operation is decided by the difference between the reference voltage and a power supply voltage, which are constant voltages. Since the reverse bias voltage applied to the light-receiving element influences the characteristics of the light-receiving element such as a response speed and a dark current amount, the controllability of APC can be improved by controlling the reverse bias voltage.

Some embodiments of the present invention provide a technique advantageous in improving the controllability of APC.

According to some embodiments, a printing apparatus comprising: a light-emitting element; a light-receiving element including a first terminal and a second terminal, driven by a reverse bias voltage applied between the first terminal and the second terminal, and configured to detect a light emission amount of the light-emitting element; a reference current generation unit configured to supply a reference current to a node connected to the second terminal; a comparison unit configured to compare a monitor current with the reference current, the light-receiving element supplying the monitor current to the second terminal in accordance with the light emission amount; a driving unit configured to drive the light-emitting element based on an output of the comparison unit; and a reference voltage control unit configured to control a voltage of the second terminal, wherein the comparison unit includes a first input terminal connected to the second terminal, and a second input terminal, and the reference voltage control unit is configured to supply a reference voltage selected from at least two voltage values to the second input terminal, and to control the voltage of the second terminal to be a voltage according to the reference voltage, is provided.

According to some other embodiments, a printing apparatus comprising: a light-emitting element; a light-receiving element including a first terminal and a second terminal, driven by a reverse bias voltage applied between the first terminal and the second terminal, and configured to detect a light emission amount of the light-emitting element; a reference current generation unit configured to supply a reference current to a current path; a comparison unit configured to compare a monitor current with the reference current, the monitor current being supplied to the current path based on a detection amount of the light-receiving element according to the light emission amount; a driving unit configured to drive the light-emitting element based on an output of the comparison unit; a reference voltage control unit configured to generate a reference voltage selected from at least two voltage values to control a voltage of the second terminal; and a reverse bias voltage control unit arranged between the second terminal and the comparison unit and configured to receive the reference voltage from the reference voltage control unit and to control the second terminal to a voltage according to the reference voltage, wherein the comparison unit comprises a first input terminal connected to the current path, is provided.

According to still other embodiments, a light-emitting element driving device comprising: a driving terminal configured to output a driving signal used to drive a light-emitting element; a monitor terminal configured to receive a monitor current output from a light-receiving element configured to detect a light emission amount of the light-emitting element; a reference current generation unit configured to supply a reference current to a node connected to the monitor terminal; a comparison unit configured to compare the monitor current input from the light-receiving element to the monitor terminal with the reference current; a driving unit configured to generate the driving signal based on an output of the comparison unit; and a reference voltage control unit configured to control a voltage of the monitor terminal, wherein the comparison unit includes a first input terminal connected to the monitor terminal, and a second input terminal, and the reference voltage control unit is configured to supply a reference voltage selected from at least two voltage values to the second input terminal, and to control the voltage of the monitor terminal to be a voltage according to the reference voltage, is provided.

Further features of the present invention will become apparent from the following description of exemplary embodiments (with reference to the attached drawings).

DESCRIPTION OF THE EMBODIMENTS

Figure 1:
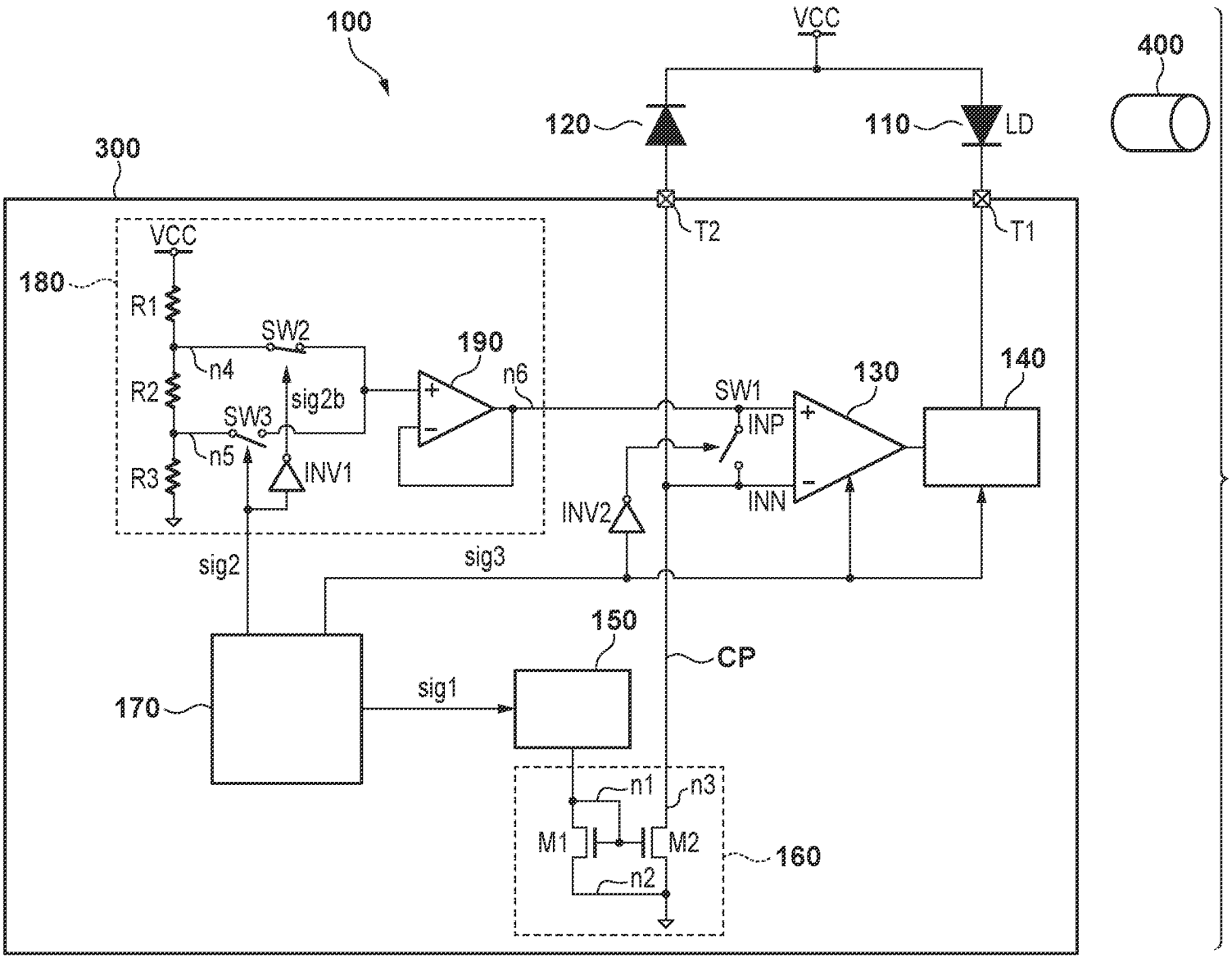
FIG. 1 is a circuit diagram showing an example of the arrangement of a printing apparatus according to the embodiment of the present invention.

A detailed embodiment of a printing apparatus according to the present invention will now be described with reference to the accompanying drawings. Note that in the following description and drawings, common reference numerals denote common components throughout a plurality of drawings. Hence, the common components will be described by cross-referencing the plurality of drawings, and a description of components denoted by common reference numerals will appropriately be omitted.

The structures and operations of a printing apparatus according to this embodiment and a light-emitting element driving device included in the printing apparatus will be described with reference to FIGS. 1, 2A, and 2B. FIG. 1 is a circuit diagram showing an example of the arrangement of a printing apparatus 100 according to the first embodiment. The printing apparatus 100 includes a light-emitting element 110, a light-receiving element 120, a light-emitting element driving device 300 (to be sometimes referred to as a device 300 hereinafter), and a photosensitive drum 400. The device 300 includes a comparison unit 130, a driving unit 140, a current generation unit 150, a reference current generation unit 160, a control unit 170, a reference voltage control unit 180, and a switch element SW1. In addition, the device 300 includes a terminal T1 (electrode pad) configured to output a driving signal used to drive the light-emitting element 110, and a terminal T2 (electrode pad) configured to receive a current output from the light-receiving element 120 that detects the light emission amount of the light-emitting element 110.

The light-emitting element 110 has an anode connected to a power supply voltage VCC, and a cathode connected to the terminal T1. The light-emitting element 110 may be, for example, a laser diode or the like. The light-emitting element 110 emits light when driven by a driving signal supplied from the driving unit 140 via the terminal T1, and the photosensitive drum 400 is irradiated with the emitted light (for example, a laser beam).

The light-receiving element 120 has a cathode terminal (first terminal) connected to the power supply voltage VCC, and an anode terminal (second terminal) connected to the terminal T2. The light-receiving element 120 may be, for example, a photoelectric conversion element such as a photodiode. The light-receiving element 120 is driven by a reverse bias voltage applied between the cathode terminal and the anode terminal, and receives the light from the light-emitting element 110, thereby detecting the light emission amount of the light-emitting element 110. The light-receiving element 120 outputs a monitor current Im corresponding to the light emission amount of the light-emitting element 110 to the terminal T2 via the anode terminal.

Constituent elements included in the device 300 will be described next. The control unit 170 may be, for example, a CPU or a processor configured to control a printing operation. The control unit 170 controls the current generation unit 150, the reference voltage control unit 180, the comparison unit 130, and the switch element SW1 using control signals sig1, sig2, and sig3.

In accordance with the control signal sig1 output from the control unit 170, the current generation unit 150 generates a standard current T1 that is a constant current according to the target value of the light emission amount of the light-emitting element 110. The current generation unit 150 supplies the standard current T1 to the reference current generation unit 160.

The reference current generation unit 160 is connected to the current generation unit 150 and a current path CP connected to the terminal T2. The reference current generation unit 160 receives the standard current T1 from the current generation unit 150, and supplies, to the current path CP, a reference current I2 of a value obtained by multiplying the value of the standard current T1 by a predetermined ratio. In other words, the reference current generation unit 160 supplies the reference current I2 to a node connected to the anode terminal of the light-receiving element 120. The reference current I2 may be referred to as a "target current" in correspondence with the target value of the light emission amount of the light-emitting element 110. In other words, the reference current generation unit 160 supplies, to the current path CP, the reference current I2 used to control the light emission amount of the light-emitting element 110 to a target value. In addition, the above-described current generation unit 150 supplies the standard current I1 according to the reference current I2 to the reference current generation unit 160. The reference current generation unit 160 may be formed by, for example, NMOS transistors. In this embodiment, the reference current generation unit 160 includes a current mirror circuit formed by transistors M1 and M2 that are NMOS transistors.

Here, a node to which the standard current I1 from the current generation unit 150 flows and which corresponds to the input terminal of the current mirror circuit of the reference current generation unit 160 is defined as a node n1. In addition, the ground node of the current mirror circuit of the reference current generation unit 160 is defined as a node n2. Furthermore, a node to which the reference current I2 flows and which corresponds to the output terminal of the current mirror circuit of the reference current generation unit 160 is defined as a node n3. That is, the node n3 is connected to the current path CP and connected to the anode terminal of the light-receiving element 120.

The transistor M1 that forms the current mirror circuit of the reference current generation unit 160 is arranged such that the drain and the gate are connected to the node n1, and the source is connected to the node n2. In addition, the transistor M2 that forms the current mirror circuit of the reference current generation unit 160 is arranged such that the gate is connected to the node n1, the source is connected to the node n2, and the drain is connected to the node n3. The transistor M2 supplies, to the current path CP, the reference current I2 of a value obtained by multiplying the value of the standard current I1 flowing to the transistor M1 by a size ratio of the transistor M1 and the transistor M2. The size ratio of the transistor M1 and the transistor M2 corresponds to the current conversion ratio of the reference current generation unit 160, and can also be expressed as the mirror ratio of the current mirror circuit.

In this embodiment, the reference current generation unit 160 configured to perform current/current conversion between the standard current I1 and the reference current I2 by the simple current mirror circuit with a gain of 1 has been described. However, the present invention is not limited to this. For example, the reference current generation unit 160 may have a circuit arrangement that includes a plurality of current mirror circuits having mirror ratios different from each other and can convert the standard current I1 by a plurality of current conversion ratios (gains). In this case, the reference current generation unit 160, for example, selects a setting of a gain from the plurality of gains in accordance with the control signal output from the control unit 170, and outputs the reference current I2 according to the target value of the light emission amount of the light-emitting element 110. In addition, the reference current generation unit 160 may use, for example, the arrangement of a cascode current mirror circuit to improve the accuracy of the reference current I2 to be output.

The reference voltage control unit 180 controls the voltage of the anode terminal of the light-receiving element 120 via the terminal T2, as will be described later in detail. The reference voltage control unit 180 includes resistors R1, R2, and R3, switch elements SW2 and SW3, a differential input amplifier 190, and an inverter INV1.

The resistors R1, R2, and R3 are connected in series between the power supply voltage VCC and a ground voltage VSS. One terminal of the switch element SW2 is connected to a node n4 that is the connection point between the resistors R1 and R2, and the other terminal is connected to the noninverting input terminal of the differential input amplifier 190. One terminal of the switch element SW3 is connected to a node n5 that is the connection point between the resistors R2 and R3, and the other terminal is connected to the noninverting input terminal of the differential input amplifier 190. The differential input amplifier 190 has an arrangement of a voltage follower circuit in which the noninverting input terminal and a node n6 that is the output terminal are connected, and outputs a voltage input to the noninverting input terminal of the differential input amplifier 190 to the node n6 as a reference voltage VR. The control signal sig2 is input to the switch element SW3 and the inverter INV1, and a signal whose logic is inverted by the inverter INV1 is input to the switch element SW2.

In the reference voltage control unit 180, when the control signal sig2 output from the control unit 170 is L (low level), the switch element SW2 is turned on, and the switch element SW3 is turned off. Accordingly, a voltage obtained by buffering the voltage of the node n4 by the differential input amplifier 190 is output as a reference voltage VR. The reference voltage VR in this case will sometimes be referred to as a reference voltage VRH hereinafter. Additionally, in the reference voltage control unit 180, when the control signal sig2 output from the control unit 170 is H (high level), the switch element SW2 is turned off, and the switch element SW3 is turned on. Accordingly, a voltage obtained by buffering the voltage of the node n5 by the differential input amplifier 190 is output as the reference voltage VR. The reference voltage VR in this case will sometimes be referred to as a reference voltage VRL hereinafter.

As described above, the reference voltage control unit 180 includes a voltage generation unit that generates at least two voltages of different voltage values, and a voltage follower circuit that receives the output from the voltage generation unit. The reference voltage control unit 180 selectively turns on one of the switch element SW2 and the switch element SW3 in response to the control signal sig2 output from the control unit 170, and outputs one of the reference voltages VRH and VRL. The one of the reference voltages VRH and VRL is supplied to the noninverting input terminal (second input terminal) of the comparison unit 130 to be described later. In other words, the reference voltage control unit 180 supplies the reference voltage VR selected from at least two (two types of) voltage values to the noninverting input terminal of the comparison unit 130.

In this embodiment, an example in which as the voltage generation unit of the reference voltage control unit 180, a voltage-dividing circuit that divides the power supply voltage VCC by the three resistors R1 to R3 to generate two voltages having voltage values different from each other has been described. However, the arrangement of the reference voltage control unit 180 is not limited to this, and the arrangement need only supply or internally generate a plurality of voltages of different voltage values and output one of the voltages in accordance with the control signal sig2 output from the control unit 170.

The comparison unit 130 compares the monitor current Im with the reference current I2, the light-receiving element 120 supplying the monitor current Im to the anode terminal in accordance with the light emission amount of the light-emitting element 110. The comparison unit 130 includes an inverting input terminal INN (first input terminal) connected to the current path CP, and a noninverting input terminal INP to which the reference voltage VR is supplied. More specifically, the node n3 corresponding to the output terminal of the current mirror circuit of the reference current generation unit 160 is connected to the inverting input terminal INN via the terminal T2 and the current path CP via the anode terminal of the light-receiving element 120 and the current path CP. Accordingly, the monitor current Im that flows from the light-receiving element 120 and the reference current I2 that flows from the reference current generation unit 160 are input to the inverting input terminal INN of the comparison unit 130. In addition, the node n6 corresponding to the output terminal of the voltage follower circuit of the reference voltage control unit 180 is connected to the noninverting input terminal INP, and the reference voltage VR is supplied from the reference voltage control unit 180.

The difference between the monitor current Im and the reference current I2 is current/voltage-converted by the inverting input terminal INN of the comparison unit 130. If the monitor current Im is larger than the reference current I2, the potential (voltage) of the inverting input terminal INN rises. It can be considered that the input capacitance of the inverting input terminal INN is charged by the difference (Im−I2) between the monitor current Im and the reference current I2 (<Im). From another viewpoint, it may be considered that since the charge amount generated in the light-receiving element 120 per unit time is larger than the reference current I2, charges increase in the light-receiving element 120, and the increased charges raise the potential of the inverting input terminal INN.

In addition, if the monitor current Im is smaller than the reference current I2, the potential (voltage) of the inverting input terminal INN lowers in the ground voltage direction. It can be considered that discharge from the input capacitance of the inverting input terminal INN is caused by the difference (I2−Im) between the monitor current Im and the reference current I2 (>Im). From another viewpoint, it may be considered that since the charge amount generated in the light-receiving element 120 per unit time is smaller than the reference current I2, charges decrease in the light-receiving element 120, and the decreased charges lower the potential of the inverting input terminal INN.

In this embodiment, the comparison unit 130 compares the monitor current Im with the reference current I2 by the above-described arrangement. Based on the output according to the comparison between the monitor current Im and the reference current I2 by the comparison unit 130, the driving unit 140 drives the light-emitting element 110, and feedback control is performed to control the light emission amount of the light-emitting element 110 to the target value. Hence, when the current value of the monitor current Im and the current value of the reference current I2 become equal to each other, the potential of the inverting input terminal INN can be equal to the reference voltage VR. The components of the device 300 may operate to determine that the light emission amount of the light-emitting element 110 becomes the target value when such a state occurs. Here, in feedback control, the potential of the inverting input terminal INN need not always equal the reference voltage VR, and it is only necessary to change the light emission amount of the light-emitting element 110 in accordance with the result of comparison between the monitor current Im and the reference current I2.

Additionally, in this embodiment, the device 300 of the printing apparatus 100 includes the switch element SW1 configured to connect the inverting input terminal INN and the noninverting input terminal INP of the comparison unit 130, as shown in FIG. 1. An inverted signal obtained by logic-inverting, by an inverter INV2, the control signal sig3 output from the control unit 170 is input to the switch element SW1. The control signal sig3 is a signal used to control the APC operation, and is supplied to the inverter INV2, the comparison unit 130, and the driving unit 140, as will be described later in detail.

The driving unit 140 generates a driving signal used to drive the light-emitting element 110 via the terminal T1 based on the output of the comparison unit 130. More specifically, the driving unit 140 includes, for example, an information holding unit (for example, a sampling circuit), and a driver unit. The driving unit 140 holds the output from the comparison unit 130 at the time of completion of APC in the information holding unit as information used to control the light emission amount of the light-emitting element 110 to the target value. In subsequent printing, the driver unit drives the light-emitting element 110 using the driving signal according to the information held in the information holding unit, and the light-emitting element 110 irradiates the photosensitive drum 400 with light in a light emission amount according to the driving signal.

As described above, the light-emitting element 110, the light-receiving element 120, the comparison unit 130, the driving unit 140, the current generation unit 150, the reference current generation unit 160, the reference voltage control unit 180, and the switch element SW1 constitute a feedback system configured to make the light emission amount of the light-emitting element 110 close to the target value. By feedback control using the feedback system, auto power control (APC) is implemented. In this embodiment, an example in which the anode driving type light-emitting element 110 is used has been described. However, an arrangement using a cathode driving type light-emitting element may be employed.

An APC operation according to this embodiment will be described next with reference to FIGS. 2A and 2B. FIGS. 2A and 2B are timing charts showing an APC operation in a case in which one or more APC operations were already ended to control the light-emitting element 110 to a desired light amount, and the APC operation is further performed from this state. For example, when a laser printer performs printing, the APC operation is performed for each line space in some cases. In this case, the APC operation needs to be performed correctly within a predetermined time.

Figure 2A:
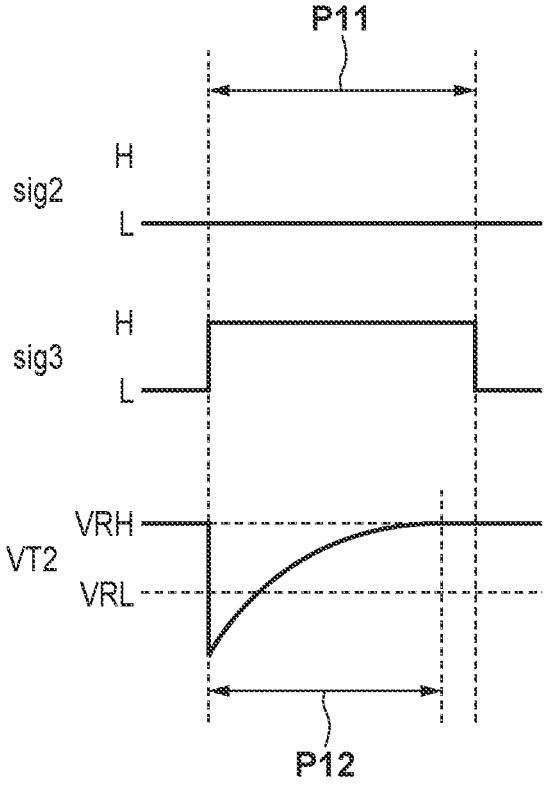
FIGS. 2A and 2B are timing charts showing an example of the operation of the printing apparatus shown in FIG. 1.
Figure 2B:
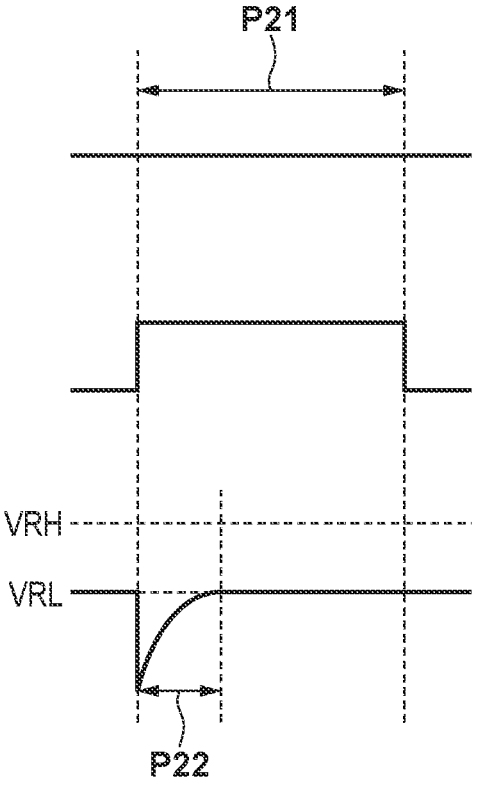

In FIGS. 2A and 2B, the ordinate represents the voltage values of the control signals sig2 and sig3 and the terminal T2, and the abscissa represents time. FIG. 2A shows the APC operation performed when the control signal sig2 output from the control unit 170 is L (low level) and, accordingly, the reference voltage control unit 180 outputs the reference voltage VRH. FIG. 2B shows the APC operation performed when the control signal sig2 output from the control unit 170 is H (high level) and, accordingly, the reference voltage control unit 180 outputs the reference voltage VRL.

Referring to FIG. 2A, first, when the control signal sig3 before the comparison between the monitor current Im and the reference current I2 is L, the driving unit 140 of the comparison unit 130 is inactive. The APC operation is not performed, and the light-emitting element 110 is not driven. Additionally, at this time, the switch element SW1 to which the inverted signal of the control signal sig3 is input is turned on, and the inverting input terminal INN and the noninverting input terminal INP of the comparison unit 130 are electrically connected. Hence, the terminal T2 is electrically connected, via the switch element SW1, to the node n6 that is the output terminal of the reference voltage control unit 180. That is, the voltage of the anode terminal of the light-receiving element 120 connected to the terminal T2 becomes the reference voltage VRH (a small voltage drop in the current path CP and the like is ignored here). Hence, a voltage (VCC−VRH) of a value obtained by subtracting the reference voltage VRH from the power supply voltage VCC applied between the cathode terminal and the anode terminal is applied as a reverse bias voltage VPDRH to the light-receiving element 120.

Next, when the control signal sig3 changes to H, and a period P11 in which the APC operation of comparing the monitor current Im with the reference current I2 is performed starts, the comparison unit 130 and the driving unit 140 become active. The driving unit 140 drives the light-emitting element 110 in accordance with the output of the comparison unit 130. In addition, during the period P11 in which the APC operation is performed, the switch element SW1 to which the inverted signal of the control signal sig3 is input is turned off, and the electrical connection between the inverting input terminal INN and the noninverting input terminal INP of the comparison unit 130 is released.

The light-emitting element 110 is driven by the driving unit 140, the light-receiving element 120 outputs the monitor current Im according to the light emission amount of the light-emitting element 110, and the comparison unit 130 outputs the result of comparison between the monitor current Im and the reference current I2 to the driving unit 140. Accordingly, a feedback loop is formed, and the APC operation is performed.

At this time, focus is placed on a terminal voltage VT2 of the terminal T2 connected to the anode terminal of the light-receiving element 120. Immediately after the start of the period P11, the monitor current Im is not output due to the response delay of the light-receiving element 120, and the like, and the switch element SW1 is turned off. For this reason, the terminal voltage VT2 lowers in the ground voltage direction from the reference voltage VRH via the transistor M2 of the reference current generation unit 160.

After that, when the monitor current Im is output from the light-receiving element 120, the terminal voltage VT2 rises to the target voltage (reference voltage VRH). Next, when the monitor current Im and the reference current I2 balance, and the terminal voltage VT2 converges to the reference voltage VRH by the feedback control, the APC operation is completed.

At this time, if the response speed of the light-receiving element 120 is low, and a long time is needed until the value according to the light emission amount of the light-emitting element 110 is output as the monitor current Im, a period P12 until the terminal voltage VT2 converges to the target voltage becomes long. In general, the response speed of the light-receiving element 120 changes depending on the voltage value of the reverse bias voltage applied to the light-receiving element 120 when the light-receiving element 120 is driven. The smaller the reverse bias voltage value is, the lower the response speed is. The larger the reverse bias voltage value is, the higher the response speed is. On the other hand, if the reverse bias voltage applied when the light-receiving element 120 is driven is large, the dark current amount of the light-receiving element 120 becomes large. Hence, it can be said that in the APC operation, an appropriate reverse bias voltage used to obtain a desired response speed or dark current amount changes depending on the light-receiving element 120 or the target value of the light emission amount of the light-emitting element 110.

In the operation shown in FIG. 2B, the control signal sig2 is H, and the reference voltage control unit 180 outputs the reference voltage VRL. For this reason, when the control signal sig3 is L, the terminal voltage VT2 of the terminal T2 connected to the anode terminal of the light-receiving element 120 changes to the reference voltage VRL via the switch element SW1. Hence, a voltage (VCC−VRL) of a value obtained by subtracting the reference voltage VRL from the power supply voltage VCC applied between the cathode terminal and the anode terminal is applied as a reverse bias voltage VPDRL to the light-receiving element 120. Since the reference voltage VRL is smaller than the above-described reference voltage VRH, as shown in FIG. 2B, the reverse bias voltage VPDRL applied to the light-receiving element 120 becomes larger than the above-described reverse bias voltage VPDRH.

For this reason, when a period P21 (in this embodiment, the period P11 and the period P21 have the same length) in which the control signal sig3 changes to H, and the APC operation is performed starts, the APC operation is started like the operation shown in FIG. 2A. However, the value of the reverse bias voltage VPDRL used to drive the light-receiving element 120 is larger than the value of the reverse bias voltage VPDRH in the case shown in FIG. 2A. As a result, the response speed of the light-receiving element 120 becomes high, and the time until the monitor current Im is output, or a period P22 until the terminal voltage VT2 converges to the target voltage (reference voltage VRL) after that becomes short.

Here, to avoid an influence on the APC operation, the timing of switching the control signal sig2 may be in a period (APC non-operation period) in which the above-described feedback loop is not formed. That is, the control unit 170 switches the control signal sig2 as needed in the period in which the control signal sig3 is L.

Here, referring back to FIG. 1, the terminal voltage VT2 of the terminal T2 connected to the anode terminal of the light-receiving element 120 after the APC convergence can converge to the reference voltage output from the reference voltage control unit 180 because the feedback loop is formed. That is, it can also be said that the voltage of the anode terminal of the light-receiving element 120 after the APC convergence is controlled by the control signal sig2. In addition, a voltage VDS2 that is the voltage between the drain and the source of the transistor M2 of the reference current generation unit 160 has the same value as the terminal voltage VT2. For this reason, the voltage VDS2 after the APC convergence can have the same value as the reference voltage VRH when the control signal sig2 is L, and can have the same value as the reference voltage VRL when the control signal sig2 is H.

Hence, if the control signal sig2 is L, the voltage VDS2 is larger, as compared to a case in which the control signal sig2 is H (VRH>VRL). For this reason, the conversion accuracy of the reference current generation unit 160 may become high. More specifically, for example, if the voltage VDS2 equals the reference voltage VRL, the value of the voltage VDS2 between the drain and the source of the transistor M2 is low, the transistor M2 operates in a linear region, and a desired current ratio is not obtained in some cases. On the other hand, if the voltage VDS2 equals the reference voltage VRH larger than the reference voltage VRL, the transistor M2 operates in a saturation region, and the possibility that a desired current ratio is obtained may be higher than in a case in which the voltage VDS2 equals the reference voltage VRL. For this reason, if the control signal sig2 is L, the conversion accuracy of the reference current generation unit 160 may become high.

In the above-described way, in this embodiment, the reverse bias voltage to be applied to the light-receiving element 120 can be controlled in accordance with the control signal sig2 output from the control unit 170. This makes it possible to control the response speed and the dark current of the light-receiving element 120 and also control the conversion accuracy of the reference current generation unit 160.

This indicates that the reverse bias voltage used to drive the light-receiving element 120, which changes depending on the target value of the light emission amount of the light-emitting element 110, can be adjusted by the control signal sig2. That is, the controllability of APC can be improved. In addition, even if the characteristic of the light-receiving element 120, and the like vary, an appropriate reverse bias voltage can be applied to the light-receiving element 120. That is, the degree of freedom in designing the APC circuit can be improved.

For example, if the target value of the light emission amount of the light-emitting element 110 is large, the monitor current Im becomes large, and the response speed of the light-receiving element 120 relatively lowers. As a result, the APC convergence time can be long. In this case, control may be done to select a low voltage as the reference voltage VR to be output from the reference voltage control unit 180 and increase the reverse bias voltage of the light-receiving element. When a low voltage is selected as the reference voltage VR, the response speed of the light-receiving element 120 increases. In addition, if the target value of the light emission amount of the light-emitting element 110 is small, control may be done to select a high voltage as the reference voltage VR and increase the voltage VDS2 between the source and the drain of the transistor M2 of the reference current generation unit 160. This can suppress the dark current generated in the light-receiving element 120, raise the conversion accuracy of the reference current generation unit 160, and raise the adjustment accuracy of the light emission amount even upon appropriate light emission of the light-emitting element 110.

For example, to cause the light-emitting element 110 to emit light in a first light amount, the control unit 170 outputs the control signal sig2 to the reference voltage control unit 180 such that the reference voltage control unit 180 supplies a first voltage as the reference voltage VR. On the other hand, to cause the light-emitting element 110 to emit light in a second light amount larger than the first light amount, the control unit 170 may output the control signal sig2 to the reference voltage control unit 180 such that the reference voltage control unit 180 supplies, as the reference voltage VR, a second voltage that has an absolute value smaller than that of the first voltage and has the same polarity as the first voltage.

As described above, FIGS. 2A and 2B are timing charts showing an APC operation in a case in which one or more APC operations were already ended, and the APC operation is further performed from this state. However, this embodiment need not always be applied to this case. For example, this embodiment can also be applied when performing the APC operation in the first calibration step or the like after the printing apparatus is powered on.

Figure 3:
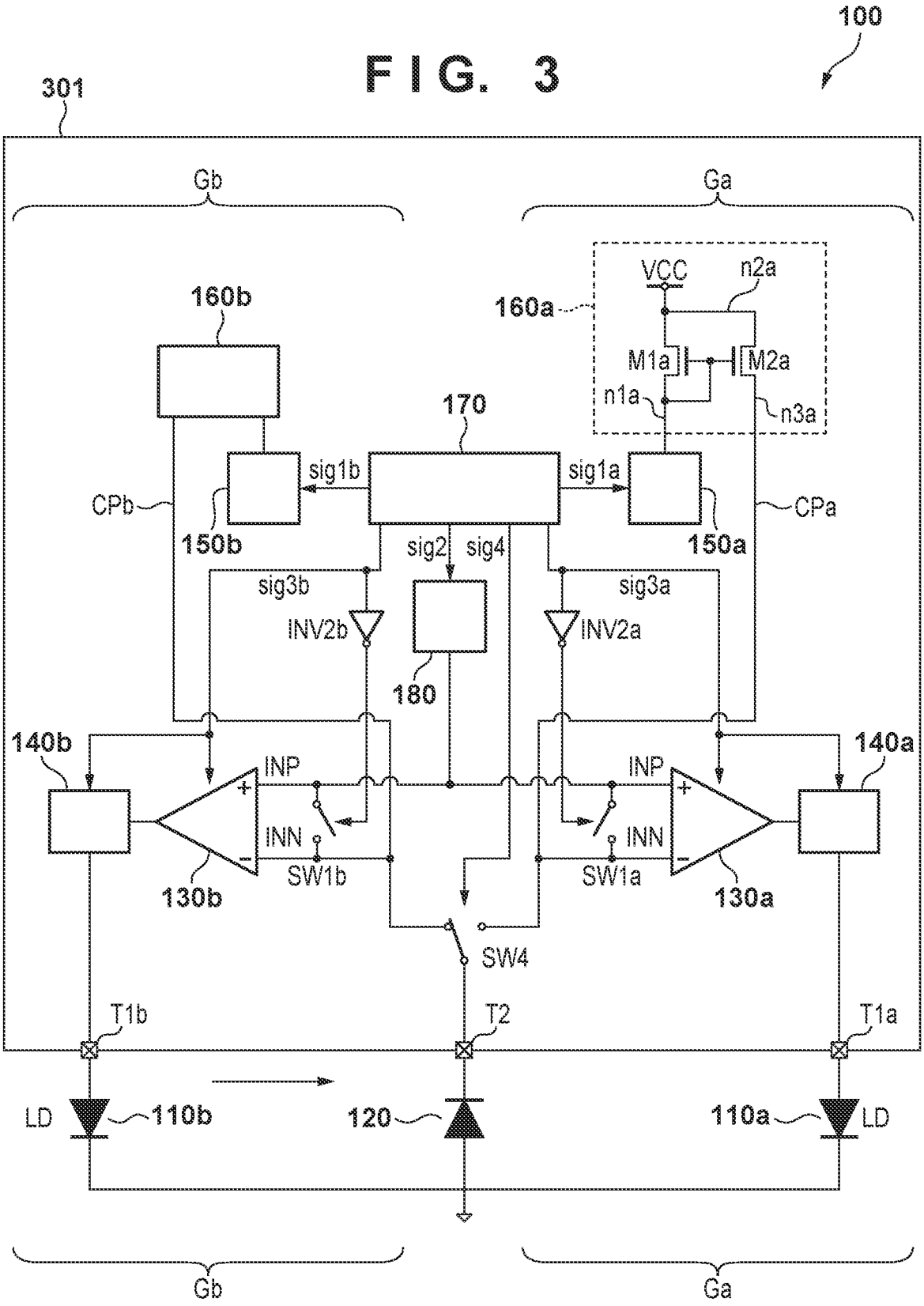
FIG. 3 is a circuit diagram showing a modification of the printing apparatus shown in FIG. 1.

The structure and operation of a printing apparatus 100 according to this embodiment will be described with reference to FIG. 3. FIG. 3 is a circuit diagram showing an example of the arrangement of a light-emitting element 110, a light-receiving element 120, and a light-emitting element driving device 301 (to be sometimes referred to as a device 301 hereinafter) included in the printing apparatus 100 according to the second embodiment.

In this embodiment, the cathode terminal of the light-emitting element 110 and the anode terminal of the light-receiving element 120 are connected to a common ground voltage VSS, unlike the printing apparatus 100 according to the above-described first embodiment. That is, the light-emitting element 110 is the cathode driving type light-emitting element 110. For this reason, since the polarity of the current of a monitor current Im output from the light-receiving element 120 to a terminal T2 is opposite to that in the first embodiment, a reference current generation unit 160 is formed by transistors M1 and M2 using PMOS transistors. In addition, the light-emitting element 110, a comparison unit 130 a driving unit 140, an inverter INV2, a switch element SW1, and a terminal T1 that outputs a driving signal used to drive the light-emitting element 110 form one group G. The device 301 includes a plurality of groups G. In addition, the device 301 includes an inter-group switch element SW4. The remaining components of the printing apparatus 100 may be similar to the components of above-described first embodiment. Hence, the device 301 different from that of the first embodiment will mainly be described here. In addition, for the descriptive convenience, two groups G are arranged on the device 301, as shown in FIG. 3, and are referred to as a group Ga and a group Gb, respectively.

As shown in FIG. 3, the comparison unit 130, the driving unit 140, a current generation unit 150, and the reference current generation unit 160 are arranged in correspondence with each of the groups Ga and Gb. In addition, the reference voltage control unit 180 may be arranged in correspondence with each of the groups Ga and Gb, like the comparison unit 130 and the driving unit 140. On the other hand, since one light-receiving element 120 is arranged, the degree of freedom in designing the APC circuit is not greatly decreased even if a reference voltage VR is common to the groups Ga and Gb. To suppress the circuit scale, one reference voltage control unit 180 may be arranged, as shown in FIG. 3.

In the arrangement shown in FIG. 3, to make a discrimination of constituent elements such as the light-emitting element 110 between the group Ga and the group Gb, "a" or "b" is added to the end of each reference numeral or symbol if it is necessary to discriminate which group G a constituent element belongs to. For example, the light-emitting element 110 of the group Ga will be referred to as "light-emitting element 110*a*" (this also applies to the other constituent elements).

As shown in FIG. 3, the inter-group switch element SW4 is arranged to connect an inverting input terminal INNa of a comparison unit 130*a* or an inverting input terminal INNb of a comparison unit 130*b* to the terminal T2. The inter-group switch element SW4 selectively connects the terminal T2 connected to the cathode terminal of the light-receiving element 120 and the comparison unit 130 included in one of the plurality of groups G in accordance with a control signal sig4 output from a control unit 170. When the device 301 has such an arrangement, the APC operation for the group Ga and the APC operation for the group Gb can sequentially be performed.

More specifically, the inter-group switch element SW4 electrically connects the terminal T2 and the inverting input terminal INNa to perform the APC operation of the group Ga and control the light amount of the light-emitting element 110*a*. Next, the inter-group switch element SW4 electrically connects the terminal T2 and the inverting input terminal INNb to perform the APC operation of the group Gb and control the light amount of the light-emitting element 110*b*.

According to this embodiment, for example, even if the cathode driving type light-emitting element 110 is used, the same effect as in the above-described first embodiment can be obtained. Additionally, even in the printing apparatus 100 (for example, the printing apparatus 100 compatible with multibeam) in which the plurality of groups G each including the light-emitting element 110, the comparison unit 130, and the driving unit 140 are arranged, the same effect as in the above-described first embodiment can be obtained for each light-emitting element 110. Additionally, in the arrangement shown in FIG. 3, an example in which the two groups G including the group Ga and the group Gb are arranged on the device 301 has been described. However, three or more groups G may be arranged.

Figure 4:
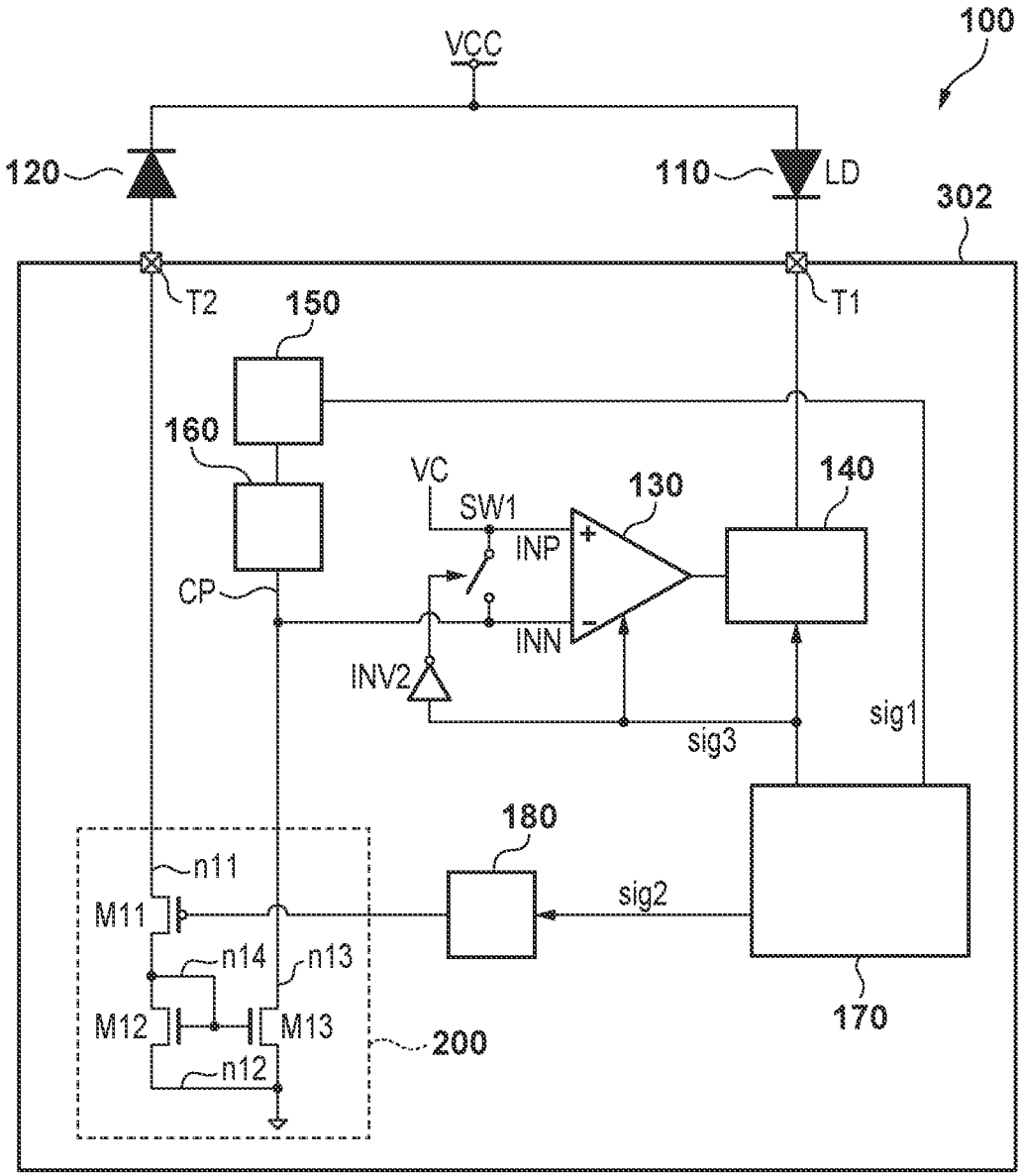
FIG. 4 is a circuit diagram showing a modification of the printing apparatus shown in FIG. 1.

The structure and operation of a printing apparatus 100 according to this embodiment will be described with reference to FIG. 4. FIG. 4 is a circuit diagram showing an example of the arrangement of a light-emitting element 110, a light-receiving element 120, and a light-emitting element driving device 302 (to be sometimes referred to as a device 302 hereinafter) included in the printing apparatus 100 according to the third embodiment.

In this embodiment, a reverse bias voltage control unit 200 is arranged between a comparison unit 130 and a terminal T2 of the device 302 connected to the anode terminal of the light-receiving element 120. The reverse bias voltage control unit 200 receives a reference voltage VR from a reference voltage control unit 180, and controls the anode terminal of the light-receiving element 120 to a voltage according to the reference voltage via the terminal T2. In addition, a comparison voltage VC is supplied to a noninverting input terminal INP of the comparison unit 130. Furthermore, a monitor current Im output from the reverse bias voltage control unit 200 is supplied to a current path CP to which a reference current I2 used to control the light emission amount to a target value is supplied from a reference current generation unit 160, unlike the device 300 according to the above-described first embodiment. The remaining components of the device 302 may be similar to the components of above-described device 300, and a description thereof will be omitted here.

The reverse bias voltage control unit 200 will be described first. The reverse bias voltage control unit 200 includes a transistor M11 using a PMOS transistor, and transistors M12 and M13 using NMOS transistors. The transistors M12 and M13 form a current mirror circuit. That is, the reverse bias voltage control unit 200 includes the current mirror circuit formed by the transistors M12 and M13, and the transistor M11 arranged between the current mirror circuit and the terminal T2 connected to the anode terminal of the light-receiving element 120. One (source) of the main terminals of the transistor M11 is connected to the anode terminal of the light-receiving element 120 via the terminal T2, and the other (drain) is connected to the current mirror circuit. In addition, the control terminal (gate) of the transistor M11 is connected to a terminal from which the reference voltage control unit 180 outputs the reference voltage VR.

A node corresponding to the input terminal of the reverse bias voltage control unit 200, which is connected to the terminal T2 to which a current Ip supplied from the light-receiving element 120 in accordance with the light emission amount of the light-emitting element 110 flows, is defined as a node n11. That is, the node n11 is connected to the anode terminal of the light-receiving element 120. Furthermore, the ground node is defined as a node n12. In addition, a node corresponding to the output terminal of the reverse bias voltage control unit 200, through which the reverse bias voltage control unit 200 supplies a current according to the current Ip flowing through the terminal T2 connected to the anode terminal of the light-receiving element 120 as the monitor current Im to the current path CP, is defined as a node n13. The node n13 is connected to the reference current generation unit 160 and an inverting input terminal INN of the comparison unit 130 via the current path CP. The transistor M11 has a source connected to the node n11, a gate to which the reference voltage VR is supplied, and a drain to which the drain and the gate of the transistor M12 and the gate of the transistor M13 are connected. The transistor M12 has a source connected to the node n12, and the transistor M13 has a source connected to the node n12, and a drain connected to the node n13.

The transistor M13 supplies, to the current path CP, the monitor current Im of a value obtained by multiplying the value of the current Ip that flows from the light-receiving element 120 to the transistor M12 by the size ratio (mirror ratio) of the transistor M12 and the transistor M13. Hence, it can be said that the monitor current Im is a current supplied to the current path CP based on the detection amount of the light-receiving element 120 according to the light emission amount of the light-emitting element 110.

Additionally, when the current Ip flows from the light-receiving element 120 to the transistor M11, the transistor M11 performs a source follower operation. For this reason, using the reference voltage VR and a gate-to-source voltage VGS of the transistor M11, a terminal voltage VT2 of the terminal T2 connected to the anode terminal of the light-receiving element 120 is expressed as a voltage (VR+VGS). That is, the voltage applied to the anode terminal of the light-receiving element 120 via the terminal voltage VT2 can be controlled by the reference voltage VR, and as a result, the reverse bias voltage applied when driving the light-receiving element 120 can be controlled.

The comparison voltage VC input to the noninverting input terminal INP of the comparison unit 130 may be a voltage set in advance to cause the current mirror circuits included in both the reference current generation unit 160 and the reverse bias voltage control unit 200 to accurately operate when performing the APC operation. In addition, the comparison voltage VC may be a voltage whose output is controlled by an arrangement similar to the reference voltage control unit 180. For example, in a case in which the reverse bias voltage control unit 200 performs current/current conversion between the current Ip and the monitor current Im by the current mirror circuit with a gain of 1, a voltage having a value between the ground voltage and the voltage (for example, a power supply voltage VCC) of the cathode terminal of the light-receiving element may be supplied to the noninverting input terminal INP of the comparison unit 130. Similarly, in a case in which current/current conversion is performed between the current Ip and the monitor current Im by the current mirror circuit with a gain of 1, a voltage according to the reference voltage VR may be supplied to the noninverting input terminal INP. In this case, the terminal from which the reference voltage control unit 180 outputs the reference voltage VR may be connected to the noninverting input terminal INP together with the gate of the transistor M11, and the reference voltage VR may be supplied to the noninverting input terminal INP.

In this embodiment, it is possible to control the reverse bias voltage of the light-receiving element 120 and improve the degree of freedom in designing the APC circuit while maintaining a state in which the monitor current Im and the reference current I2 can accurately be adjusted. More specifically, if the target value of the light emission amount of the light-emitting element 110 using a laser diode or the like is small, and the current Ip output from the light-receiving element 120 is small, the voltage value of the reference voltage VR may be set large so the influence of the dark current of the light-receiving element 120 does not become large. Accordingly, the reverse bias voltage when driving the light-receiving element 120 becomes small, and generation of the dark current of the light-receiving element 120 is suppressed. On the other hand, if the target value of the light emission amount of the light-emitting element 110 is large, and the current Ip output from the light-receiving element is large, the voltage value of the reference voltage VR may be set small to increase the response speed of the light-receiving element 120. Accordingly, the reverse bias voltage when driving the light-receiving element 120 becomes large, the response speed of the light-receiving element 120 increases, and a period P22 shown in FIG. 2B is shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-172823, filed Sep. 14, 2018 which is hereby incorporated by reference herein in its entirety.

What is claimed is:

1. A printing apparatus comprising:

a light-emitting element;

a light-receiving element including a first terminal and a second terminal, driven by a reverse bias voltage applied between the first terminal and the second terminal, and configured to detect a light emission amount of the light-emitting element;

a reference current generation unit configured to supply a reference current to a node connected to the second terminal;

a comparison unit configured to compare a monitor current with the reference current, the light-receiving element supplying the monitor current to the second terminal in accordance with the light emission amount;

a driving unit configured to drive the light-emitting element based on an output of the comparison unit; and a reference voltage control unit configured to control a voltage of the second terminal, wherein the comparison unit includes a first input terminal connected to the second terminal, and a second input terminal, and the reference voltage control unit is configured to supply a reference voltage selected from at least two voltage values to the second input terminal, and to control the voltage of the second terminal to be a voltage according to the reference voltage.

2. The apparatus according to claim 1, wherein the reference voltage control unit comprises a voltage generation unit configured to generate at least two voltages of different voltage values, and a voltage follower circuit configured to receive an output from the voltage generation unit, and an output from the voltage follower circuit is supplied to the second input terminal.

3. The apparatus according to claim 2, wherein the voltage generation unit comprises a voltage-dividing circuit.

4. The apparatus according to claim 1, wherein the printing apparatus further comprises a switch element configured to connect the first input terminal and the second input terminal, and the switch element connects the first input terminal and the second input terminal before the monitor current and the reference current are compared, and releases the connection between the first input terminal and the second input terminal during a period in which the monitor current and the reference current are compared.

5. The apparatus according to claim 1, wherein the printing apparatus further comprises a current generation unit configured to supply a current according to the reference current to the reference current generation unit, the reference current generation unit comprises a current mirror circuit, an input terminal of the current mirror circuit of the reference current generation unit is connected to a terminal from which the current generation unit outputs the current according to the reference current, and an output terminal of the current mirror circuit of the reference current generation unit is connected to a node connected to the second terminal.

6. The apparatus according to claim 1, wherein when the light-emitting element is caused to emit light in a first light amount, the reference voltage control unit supplies a first voltage as the reference voltage, and when the light-emitting element is caused to emit light in a second light amount larger than the first light amount, the reference voltage control unit supplies, as the reference voltage, a second voltage that has an absolute value smaller than that of the first voltage and has the same polarity as the first voltage.

7. The apparatus according to claim 1, wherein the light-emitting element, the comparison unit, and the driving unit form one group, and the printing apparatus comprises a plurality of groups, and further comprises an inter-group switch element configured to selectively connect the second terminal to the comparison unit included in one group of the plurality of groups.

8. The apparatus according to claim 1, wherein the printing apparatus further comprises a photosensitive drum irradiated with light from the light-emitting element.

9. A printing apparatus comprising:

a light-emitting element;

a light-receiving element including a first terminal and a second terminal, driven by a reverse bias voltage applied between the first terminal and the second terminal, and configured to detect a light emission amount of the light-emitting element;

a reference current generation unit configured to supply a reference current to a current path;

a comparison unit configured to compare a monitor current with the reference current, the monitor current being supplied to the current path based on a detection amount of the light-receiving element according to the light emission amount;

a driving unit configured to drive the light-emitting element based on an output of the comparison unit;

a reference voltage control unit configured to generate a reference voltage selected from at least two voltage values to control a voltage of the second terminal; and a reverse bias voltage control unit arranged between the second terminal and the comparison unit and configured to receive the reference voltage from the reference voltage control unit and to control the second terminal to a voltage according to the reference voltage, wherein the comparison unit comprises a first input terminal connected to the current path.

10. The apparatus according to claim 9, wherein the reverse bias voltage control unit supplies a current according to a current flowing to the second terminal as the monitor current to the current path.

11. The apparatus according to claim 9, wherein the comparison unit further comprises a second input terminal to which a voltage having a value between a voltage of the first terminal and a ground voltage is supplied.

12. The apparatus according to claim 11, wherein the voltage according to the reference voltage is supplied to the second input terminal.

13. The apparatus according to claim 9, wherein the printing apparatus further comprises a current generation unit configured to supply a current according to the reference current to the reference current generation unit, the reference current generation unit comprises a current mirror circuit, an input terminal of the current mirror circuit of the reference current generation unit is connected to a terminal from which the current generation unit outputs the current according to the reference current, and an output terminal of the current mirror circuit of the reference current generation unit is connected to the current path.

14. The apparatus according to claim 9, wherein the reverse bias voltage control unit comprises a current mirror circuit, and a transistor arranged between the second terminal and the current mirror circuit, one of main terminals of the transistor is connected to the second terminal, and the other is connected to the current mirror circuit, and a control terminal of the transistor is connected to a terminal from which the reference voltage control unit outputs the reference voltage.

15. The apparatus according to claim 14, wherein the reference voltage control unit comprises a voltage generation unit configured to generate at least two voltages of different voltage values, and a voltage follower circuit configured to receive an output from the voltage generation unit, and an output from the voltage follower circuit is supplied to the control terminal the transistor.

16. The apparatus according to claim 15, wherein the voltage generation unit comprises a voltage-dividing circuit.

17. The apparatus according to claim 9, wherein when the light-emitting element is caused to emit light in a first light amount, the reference voltage control unit supplies a first voltage as the reference voltage, and when the light-emitting element is caused to emit light in a second light amount larger than the first light amount, the reference voltage control unit supplies, as the reference voltage, a second voltage that has an absolute value smaller than that of the first voltage and has the same polarity as the first voltage.

18. The apparatus according to claim 9, wherein the light-emitting element, the comparison unit, and the driving unit form one group, and the printing apparatus comprises a plurality of groups, and further comprises an inter-group switch element configured to selectively connect the second terminal to the comparison unit included in one group of the plurality of groups.

19. The apparatus according to claim 9, wherein the printing apparatus further comprises a photosensitive drum irradiated with light from the light-emitting element.

20. A light-emitting element driving device comprising:

a driving terminal configured to output a driving signal used to drive a light-emitting element;

a monitor terminal configured to receive a monitor current output from a light-receiving element configured to detect a light emission amount of the light-emitting element;

a reference current generation unit configured to supply a reference current to a node connected to the monitor terminal;

a comparison unit configured to compare the monitor current input from the light-receiving element to the monitor terminal with the reference current;

a driving unit configured to generate the driving signal based on an output of the comparison unit; and a reference voltage control unit configured to control a voltage of the monitor terminal, wherein the comparison unit includes a first input terminal connected to the monitor terminal, and a second input terminal, and the reference voltage control unit is configured to supply a reference voltage selected from at least two voltage values to the second input terminal, and to control the voltage of the monitor terminal to be a voltage according to the reference voltage.

* * * * *